US008267839B1

(12) United States Patent
Bartolotta

(10) Patent No.: US 8,267,839 B1
(45) Date of Patent: Sep. 18, 2012

(54) DEVICE AND METHOD FOR RESISTANCE STRETCHING OF THE MUSCLES OF THE LOWER LEG

(76) Inventor: Nicholas Andrew Bartolotta, Rancho Santa Fe, CA (US)

( * ) Notice: Subject to any disclaimer, the term of this patent is extended or adjusted under 35 U.S.C. 154(b) by 899 days.

(21) Appl. No.: 12/186,397

(22) Filed: Aug. 5, 2008

(51) Int. Cl.
*A63B 23/08* (2006.01)

(52) U.S. Cl. ..... 482/79; 482/80; 482/92; 482/148

(58) Field of Classification Search ..... 482/79, 482/80, 92, 148; 601/27, 34
See application file for complete search history.

(56) References Cited

U.S. PATENT DOCUMENTS

| | | | | |
|---|---|---|---|---|
| 4,247,996 | A * | 2/1981 | Grapin et al. | 36/103 |
| 6,206,807 | B1 * | 3/2001 | Cowans et al. | 482/79 |
| 7,192,410 | B1 * | 3/2007 | Rodgers | 602/36 |
| 2007/0149368 | A1 * | 6/2007 | Koch | 482/131 |

* cited by examiner

*Primary Examiner* — Loan Thanh
*Assistant Examiner* — Peter S Vasat
(74) *Attorney, Agent, or Firm* — Loza & Loza LLP; Heidi L. Eisenhut

(57) ABSTRACT

Methods and systems are provided for resistance stretching and strengthening of the muscles of the lower leg of a human user. The device and method provide a lever arm for hinging the foot about the ankle joint for providing resistance first against a series of concentric, and preferably but optionally, isometric contractions of the muscles of the lower leg sufficient to fatigue at least one of the muscles, and then for applying force sufficient to oppose and overcome the opposite force of the user to perform an eccentric contraction of the muscles. The device includes an elongated portion that acts as a lever arm for hinging the foot about the ankle joint and a fastening means for securing the foot against the top surface of the elongated portion and allowing for manipulation of the foot to assist in the performance of the various contractions of the muscles of the lower leg.

8 Claims, 7 Drawing Sheets

DEVICE AND METHOD FOR RESISTANCE STRETCHING OF THE MUSCLES OF THE LOWER LEG

BACKGROUND

The present invention relates to stretching and strengthening muscles of the lower leg of a human user, more specifically, stretching and strengthening muscles of the lower leg through eccentric, concentric, and optionally isometric contractions using a device that acts as a lever arm to generate the force required to effectively perform such contractions.

Physical therapy and other modalities focus on the use of biomechanically functional positions and leverage to isolate specific muscles in the body. Once isolated, the muscles can be strengthened and/or stretched using the three types of muscle contractions: (1) concentric (muscle shortens while generating force); (2) isometric (muscle maintains the same length while generating force); and (3) eccentric (muscle lengthens while generating force).

For most muscles, the leverage required to isolate and contract them is achieved simply by correctly positioning and manipulating the body. However, the human ankle joint is unique because the foot, which acts as a lever arm for the joint, is exceptionally short relative to the size of the muscles that both attach to it and cross the ankle joint. Thus, it is impossible for a therapist to generate the force required to effectively resist movement of the foot across the ankle joint. Consequently, a therapist is unable to assist the human user in performing the above types of muscle contractions. As a result, the most commonly-used method to stretch and strengthen the muscles of the back of the lower leg, or calf area, has been to place the toes on the edge of a step while hanging the heels off the edge to perform the three types of contractions.

SUMMARY

In various embodiments, the present invention provides methods and systems for resistance stretching and strengthening of the muscles of the lower leg of a human user. The present invention includes a device and a method for using the device, which a human user or therapist can use as a lever arm for hinging the foot about the ankle joint to provide the resistance required to perform various types of muscle contractions. The method for using the device begins first with a series of concentric contractions of the muscles of the lower leg sufficient to strengthen and fatigue at least one of the muscles. These are preferably, but optionally, followed by an isometric contraction used to isolate and maintain the muscle fatigue. Then the concentric (and isometric, if used) contractions are followed by eccentric contractions, which stretch the muscles of the lower leg. Thus, this method and the device provide additional length to the natural lever arm of the ankle joint, and provide a therapist or human user with a system that produces the leverage required to generate the additional force needed to strengthen and stretch the muscles of the lower leg by opposing and overcoming the force generated by the muscles of the lower leg.

The device according to one embodiment comprises an elongated portion with a top surface and a bottom surface, an attachment end, and a manipulation end. The elongated portion acts as a lever arm for hinging the foot about the ankle joint. The device according to this embodiment includes a fastening means fixed near the attachment end used for securing the foot against the top surface of the elongated portion and allowing for manipulation of the foot about the ankle joint to assist the human user and/or therapist in performing concentric and eccentric (and optionally isometric) contractions of the muscles of the lower leg.

The description in the specification is not all inclusive and, in particular, many additional features will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

One skilled in the art will readily recognize from the following discussion that alternative embodiments of the structures and methods illustrated herein may be employed without departing from the principles of the present invention.

DETAILED DESCRIPTION OF THE EMBODIMENTS

The device and method described herein are for resistance stretching and strengthening of the muscles of the lower leg, specifically the Gastrocnemius, Soleus, Peroneus Longus, Peroneus Brevis, Plantaris, Tibialis Posterior, Flexor Digitorum Longus, and Flexor Hallucis Longus in the posterior lower leg as well as the ten intrinsic muscles of toe flexion and foot eversion and inversion, and the Tibialis Anterior, Extensor Digitorum Longus, Extensor Hallucis Longus, and Peroneus Tertius in the anterior lower leg, as well as the three intrinsic muscles of toe extension and foot eversion and inversion. Resistance stretching exercises are aimed at removing muscle tension by contracting a target muscle group while it is moved through its full range of motion.

A muscle's ability to lengthen is a function of its ability to shorten, and vice versa. For example, if a muscle is flexible only to twenty-five percent (25%) greater than its resting length, then only twenty-five percent (25%) shortening (contraction) of the muscle can occur. In weight training, focusing on the "negative" or eccentric phase of a weight training exercise has been shown to increase the strength of the muscle during the "positive" or concentric phase of the exercise. However, if maximum flexibility can be achieved, such that the muscle is flexible to a full fifty percent (50%) of its resting length, then fifty percent (50%) shortening also can occur. Thus, if you use an eccentric contraction on a muscle after it is properly fatigued (e.g., via concentric and isometric contractions) then you increase both the ability of that muscle to lengthen and the ability for the muscle to shorten, thus making the muscle stronger and more flexible at the same time.

The resistance stretching described herein is assisted by a device that can attach to a human foot. The device secures the foot against the device, and acts as a lever arm for movement, hinging the foot about the ankle joint to strengthen and stretch the muscles of the anterior and posterior lower leg. To provide context, a human leg is first described, presenting the terminology used herein. Then the device is described in various embodiments, as well as methods for using the same.

Figure 1:
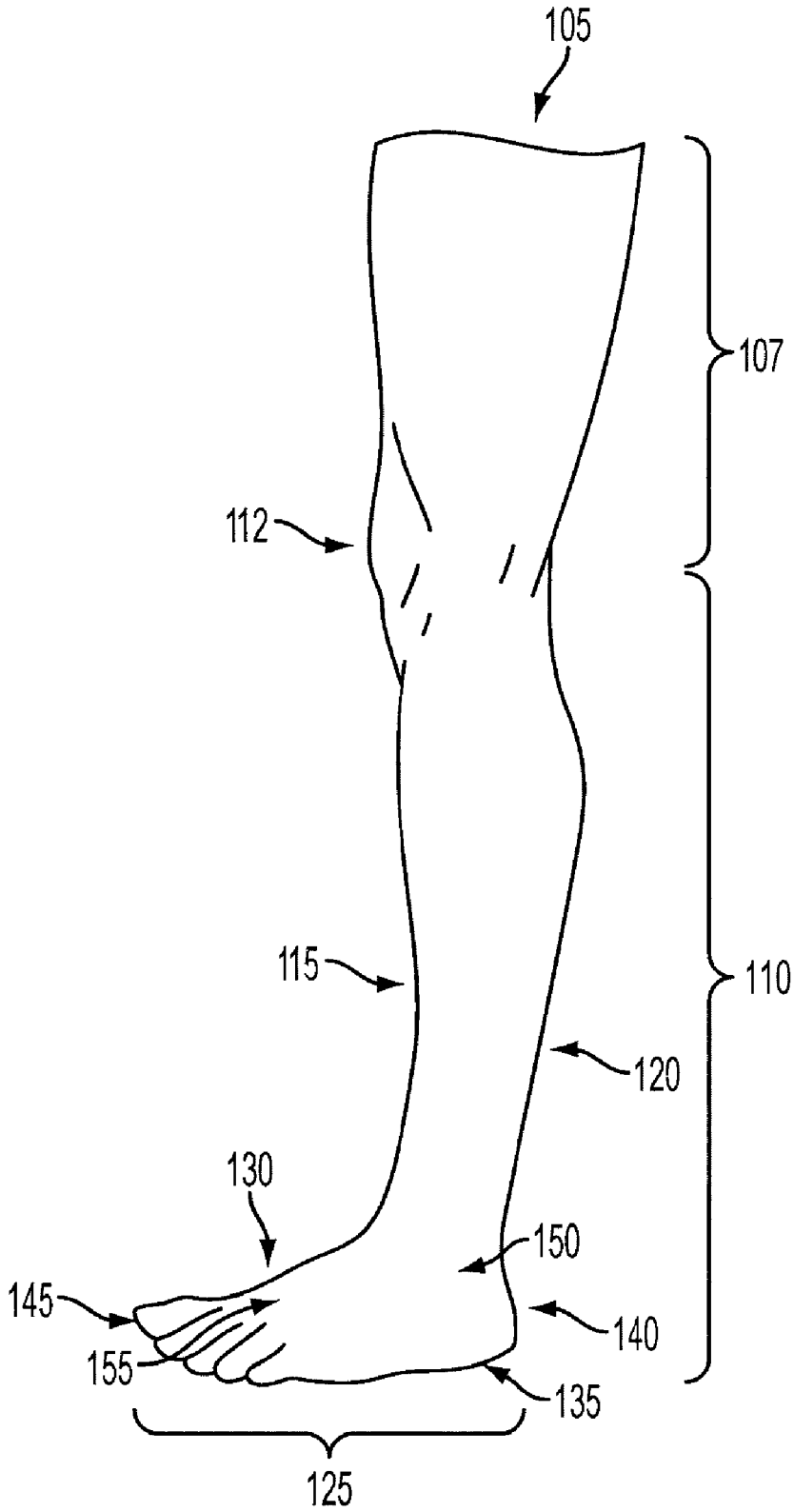
FIG. 1 is a perspective view of a leg of a human user of the present invention.

FIG. 1 is a perspective view of a leg 105 of a human user of the present invention. The leg 105 has an upper portion 107, commonly referred to as the thigh area, and a lower portion 110, commonly referred to as the calf and shin area, connected by a knee portion 112. The lower portion 110 has an anterior (front) portion 115 and a posterior (back) portion 120, according to standard anatomical positioning. The primary muscles of the anterior portion 115 used in the exercises described herein are Tibialis Anterior, Extensor Digitorum Longus, Extensor Hallucis Longus, and Peroneus Tertius; this list is meant to be exemplary but mot limiting on the scope of the present invention. The primary muscles of the posterior portion 120 used in the exercises described herein are Gastrocnemius, Soleus, Peroneus Longus, Peroneus Brevis, and Plantaris; this list is meant to be exemplary but mot limiting on the scope of the present invention.

The most distal portion of the leg 105 is the foot 125. The foot 125 has a top surface 130 and a bottom surface 135, a heel end 140 and a toe end 145, an ankle joint 150, and a metatarsal region 155 (corresponding to the location of the metatarsal bones of the foot 125) according to the description herein.

Figure 2A:
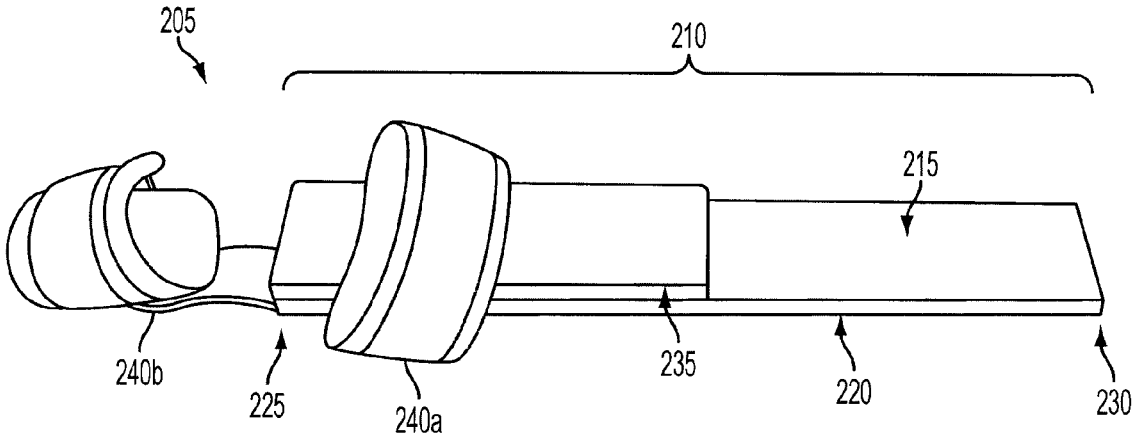
FIGS. 2A-2B are perspective views of a device for stretching and strengthening the muscles of the lower leg according to one embodiment of the present invention.

Referring now to FIG. 2A, it shows a perspective view of a device 205 for resistance stretching and strengthening the muscles of the lower leg according to one embodiment of the present invention. The device 205 includes an elongated portion 210 according to one embodiment. In other embodiments, the device 205 may alternatively have a functionally equivalent portion that performs a function similar to the elongated portion 210 as described herein, including acting as lever arm. The elongated portion 210 has a top surface 215 and a bottom surface 220, and an attachment end 225 and a manipulation end 230. The elongated portion 210 may take various shapes; in the depicted example in FIG. 2A, the elongated portion 210 is generally rectangular.

The elongated portion 210 has and elongated length with respect to the length of a human foot according to one embodiment. As described herein, an adult human foot is assumed to have a length ranging from about seven and one-half inches (7.5) to fourteen (14) inches. The elongated portion 210 has a length sufficient to provide effective leverage for movement hinging the foot about the ankle joint and/or for one or more of the manipulations described herein, e.g., between eighteen (18) and thirty (30) inches according to one embodiment, preferably 20 (twenty) to 28 (twenty-eight) inches, and more preferably 23 (twenty-three) to 25 (twenty-five) inches. In an alternative embodiment in which a functionally equivalent portion is substituted for the elongated portion 210, other shapes may be used to create leverage, such as additional width in the form of handles that could be gripped for manipulation similar to that described herein.

The elongated portion 210 has a width sufficient to accommodate a human foot. As described herein, an adult human foot is assumed to have a width ranging from three (3) to five and one-half (5.5) inches. According to one embodiment, the elongated portion 210 is at least four (4) inches wide so as to accommodate most foot widths. In an alternative embodiment, various widths of elongated portions 210 are used to accommodate multiple foot sizes. In one embodiment, the width of the elongated portion 210 is consistent along the length of the elongated portion 210 of the device 205. In an alternative embodiment, width of the elongated portion 210 varies along the length of the elongated portion 210 of the device 205, e.g., corresponding to the areas where the human foot is wider (toe end 145) or narrower (heel end 140). The elongated portion 210 has a width according to one embodiment of 3 (three) to 7 (seven) inches, preferably 3.5-5 inches, most preferably gradually increasing from 3.5 inches at the heel end 140 toward 4.75 inches nearer the toe end 145.

The elongated portion 210 may vary in thickness according to various embodiments and materials used, such that it is sufficiently rigid to provide effective leverage for one or more of the manipulations described herein. In one embodiment, the elongated portion 210 is approximately one half inch (0.5) to one (1) inch thick, preferably three quarters of an inch (0.75) thick.

The elongated portion 210 may be comprised of a variety of different materials, so long as they are of sufficient rigidity to provide effective leverage as described herein. Examples include, but are not limited to, wood, metal and metal alloys, plastics, fiberglass, carbon fiber, Kevlar, and combinations thereof.

The device 205 also includes a fastening means 240 near the attachment end 225 of the elongated portion 210, and in some embodiments, an optional cushion portion 235. The fastening means 240 may take various configurations and be made up of various materials according to various embodiments, sufficient to secure the foot 125 against the elongated portion 210, such that at least one end (i.e., toe end 145, or heel end, 140) of the bottom surface 135 of the foot 125 is aligned with the attachment end 225. The fastening means 240 may be singular or plural.

In the embodiment depicted in FIG. 2A, the fastening means 240 includes two straps. In this example, a first strap 240*a* runs transverse and approximately perpendicular to the length of the elongated portion 210 of the device 205. This first strap 240*a* is a single strip-like portion that secures the toe end 145 of the foot 125, crossing the foot 125 approximately at the metatarsal region 155.

Figure 2B:
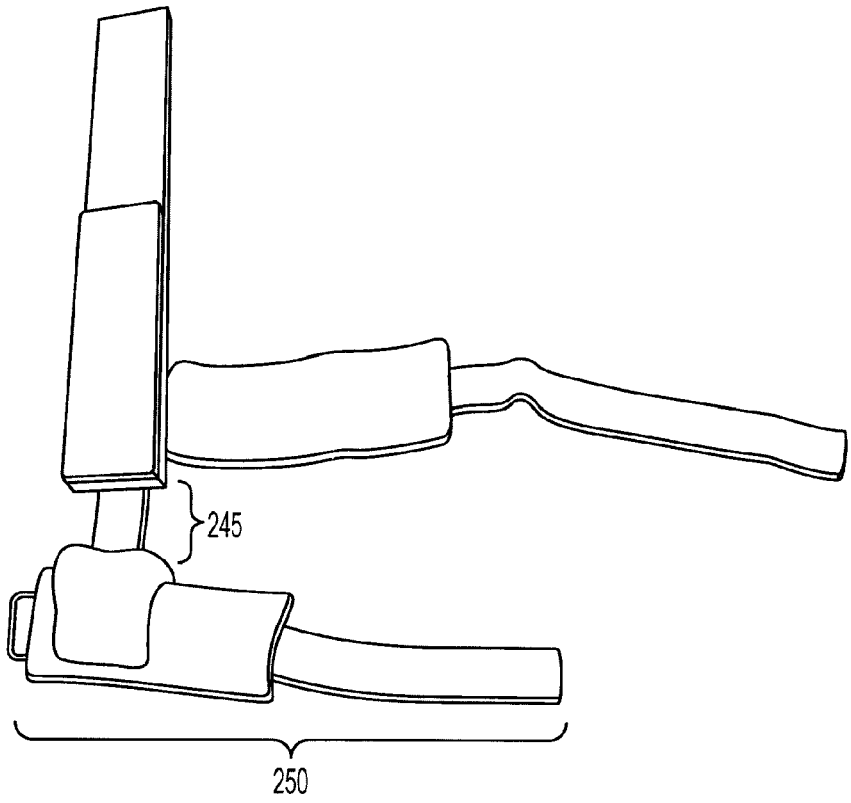

Referring briefly to FIG. 2B, the first strap 240*a* may be attached to the elongated portion 210 at one end and adjustably connectable at the other end. In this example, the first strap 240*a* is shown in an open position. Continuing with the depicted example, a second strap 240*b* approximates a T shape according to one embodiment. The second strap 240*b* has a first portion 245 that leads up from the attachment end 225 of the elongated portion 210 and a second portion 250 that runs approximately perpendicular to the first portion 245. The second strap 240*b* secures the heel end 140 of the foot 125 by the second portion 250 wrapping substantially around the lower leg 110 just above the ankle 140, and the first portion 245 attached to the elongated portion 210 at one end and the second portion 250 at the other end. Both portions 245, 250 of the T shape may be adjustable to accommodate a wide range of foot 125 sizes and ankle heights. See FIG. 2C for a perspective view of the device 205 attached to a human foot 125.

Figure 2C:
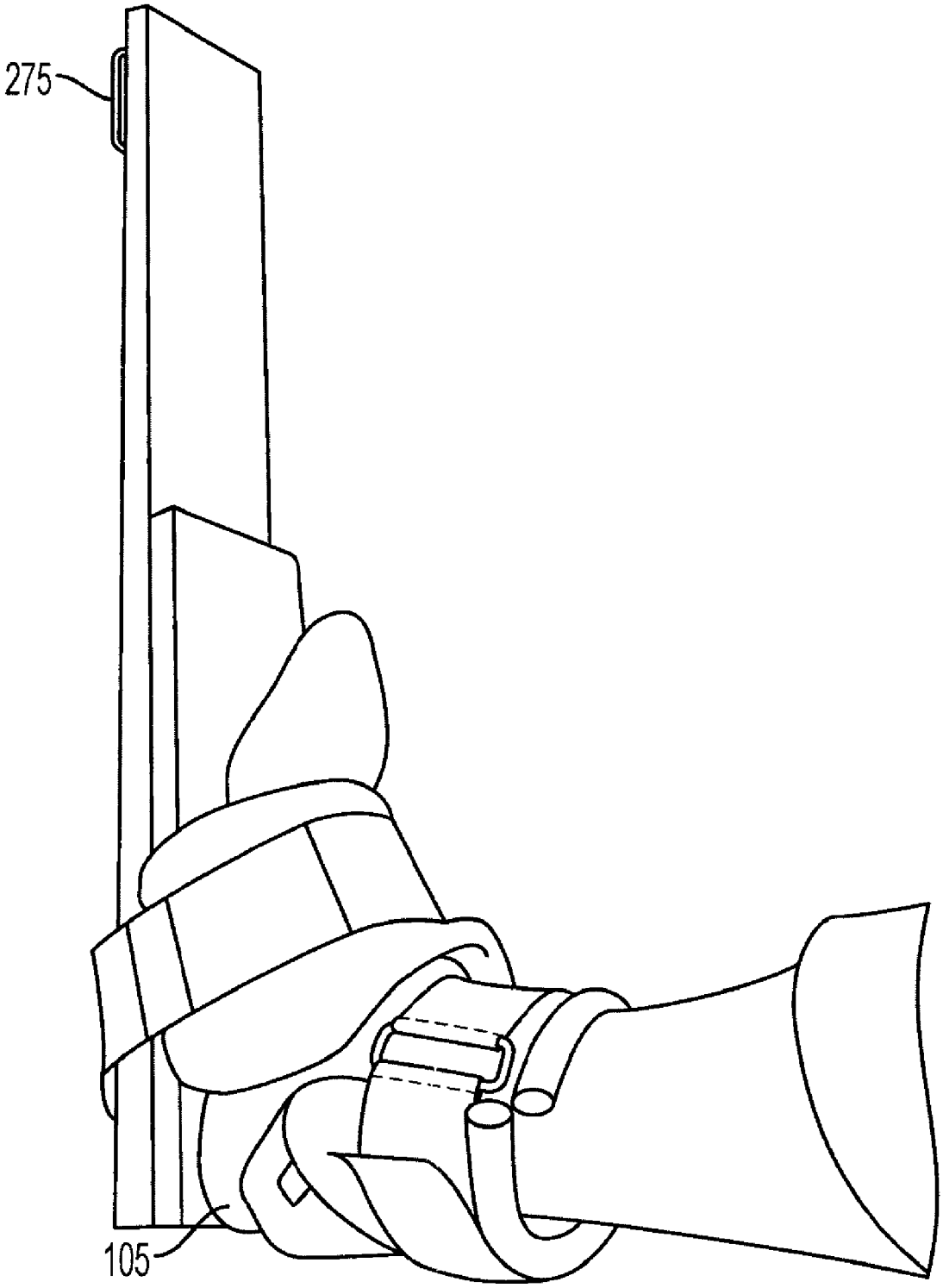
FIGS. 2C-2D are perspective views of the device for stretching and strengthening the muscles of the lower leg attached to a human foot according to one embodiment of the present invention.

In one embodiment, the first portion 245 is split at the end near the attachment end 225 of the elongated portion 210, to accommodate the shape of the heel end 140 of the foot 125. When used for the anterior muscles of the lower leg, only the first strap 240*a* is used according to one embodiment, crossing the metatarsal region 155 of the foot 125 to secure the toe end 145 of the foot 125 near the attachment end 225 of the elongated portion 210. This example is shown in FIG. 2D.

The attachment means 240 generally is made up of materials to secure the foot 125 against the elongated portion 210, while maintaining comfort for the device user. In the above embodiment in which two straps 240*a*, 240*b* are used, the straps are adjustable to achieve the proper fit. The straps 240*a*, 240*b* may be made of any material, for example nylon, materials used in medical or orthopedic braces, harnesses used for any purpose, and the like. Adjustable closure materials for the straps 240*a*, 240*b* may include Velcro, buckles, laces, hook and loop fastening materials, and the like. In some embodiments, padding or other cushioning material may be added to the straps 240*a*, 240*b* to assist in user comfort.

Figure 2E:
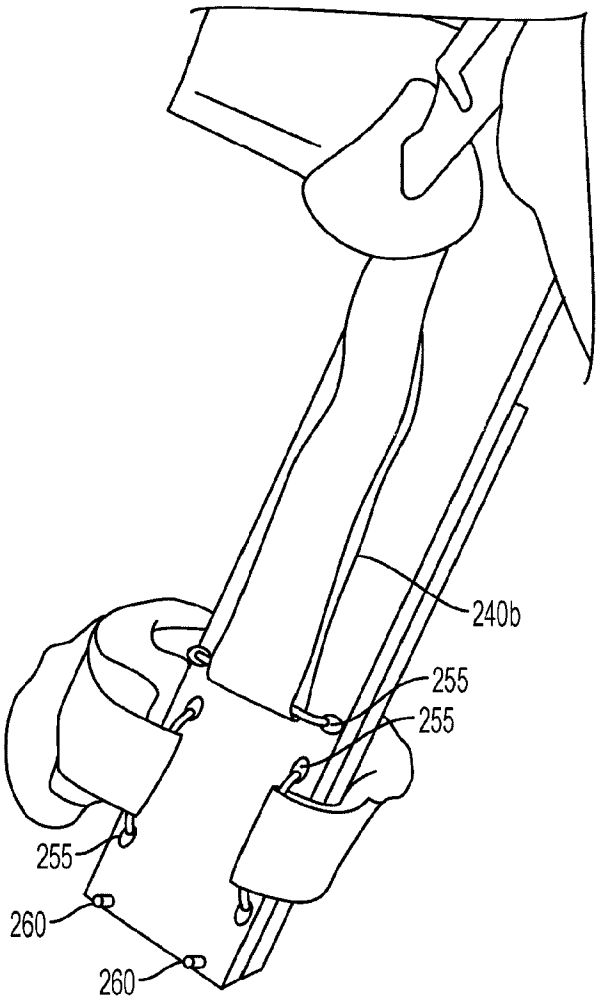
FIG. 2E is a perspective view of the bottom of a device for stretching and strengthening the muscles of the lower leg according to one embodiment of the present invention.
Figure 2D:
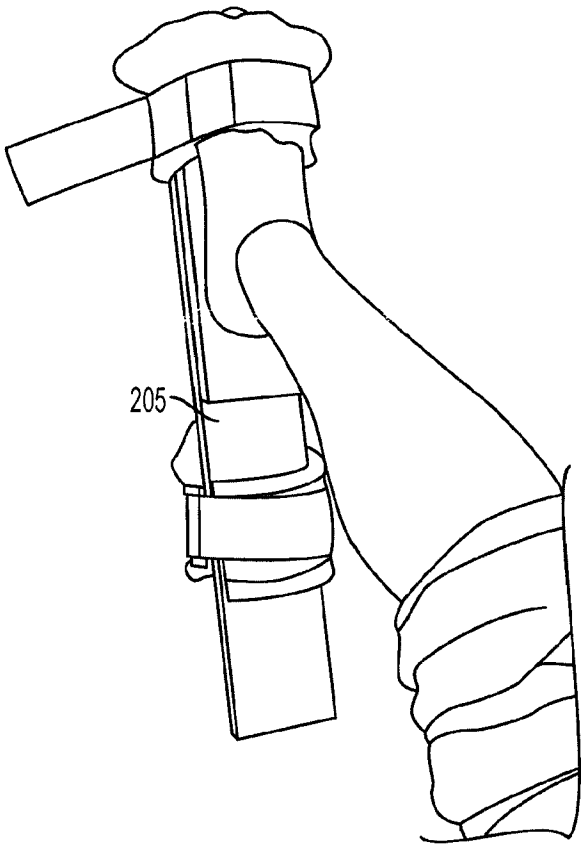

FIG. 2E is a perspective view of the bottom of a device 205 for stretching and strengthening the muscles of the lower leg according to one embodiment of the present invention. This example shows the two strap 240*a*, 240*b* configuration of the attachment means 240. Attachment points 255 for the straps 240*a*, 240*b* are shown according to one exemplary embodiment. In this example, the device 205 also includes stabilizer points 275, through which the second strap 240*b* passes before wrapping around the attachment end 225 of the elongated portion 210.

Although the above exemplary embodiments and figures have been described with respect to a device 205 using an attachment means 240 having two straps, other configurations of attachment means 240 may be used. For example, as single attachment means 240 in the form of a boot-like or shoe-like structure attached to the elongated means 210 may also be used. Similarly, embodiments with plural attachment means 240 components may use greater than two, e.g., may use a series of three or more straps that secure the foot 125 against the elongated means 210. Any attachment means 240 effective for securing the foot 125 to the device 205 for performing the methods described herein may be used and are within the scope of the present invention.

The device 205 may include an optional cushion portion 235, shown in FIG. 2A, at the attachment end 225 of the top surface 215 of the elongated member. The optional cushion portion 235 may be made of numerous materials, however, it is preferred to be made of a material sufficiently soft to allow the user's foot 125 to sink into the optional cushion portion 235 to relieve pressure on the bottom surface 135 of the foot 125.

Figure 3:
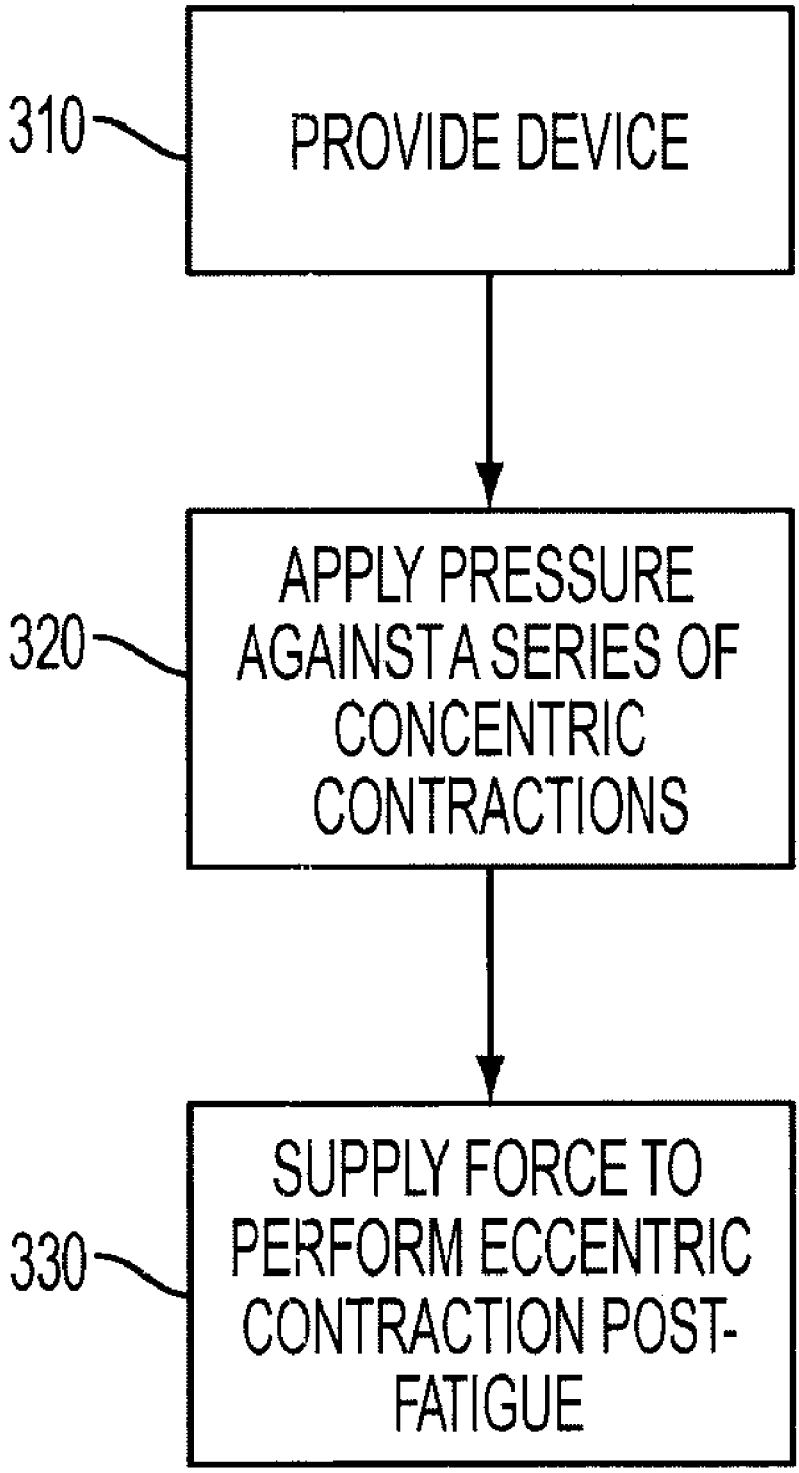
FIG. 3 is a flowchart corresponding to the method for resistance stretching of muscles of the posterior portion of the lower leg of a human user according to one embodiment of the present invention.

The device 205 also may include a self-manipulation attachment means 275 at the manipulation end 230 of the elongated portion 210, shown in FIG. 2C, for allowing a user to perform the methods described herein on him/herself, as further described in conjunction with FIGS. 3-4.

Thus, according to the various embodiments described herein, the device 205 includes an elongated portion 210 that acts as a lever arm for hinging the foot 125 about the ankle joint 150 and a fastening means 240 for securing the foot 125 against the device 205 such that a heel end 140 of the foot 125 is substantially aligned with the attachment end 225 of the elongated portion 210, or such that the toe end 145 of the foot 125 is substantially aligned with the attachment end 225 of the elongated portion 210, the fastening means 240 allowing for manipulation of the device 205 corresponding to the hinging of the foot 125 about the ankle joint 150 to assist in the performance of concentric and eccentric (and preferably, but optionally, isometric) contractions of the muscles of the lower leg 110.

Figure 4B:
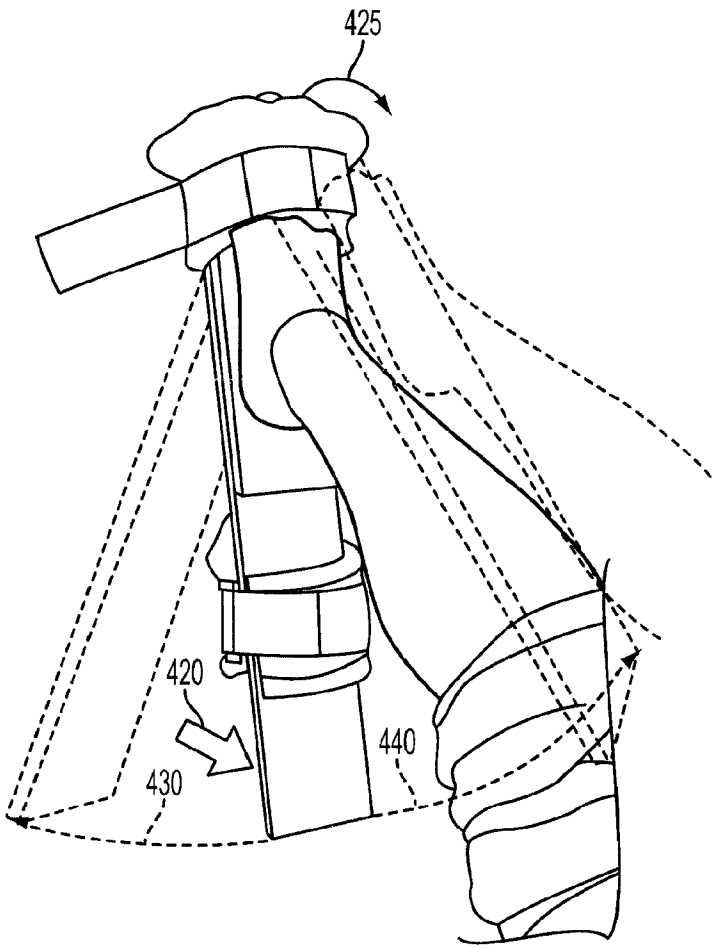
FIGS. 4A and 4B show perspective views of the device for stretching and strengthening the muscles of the lower leg attached to a human foot in use according to one embodiment of the present invention.
Figure 4A:
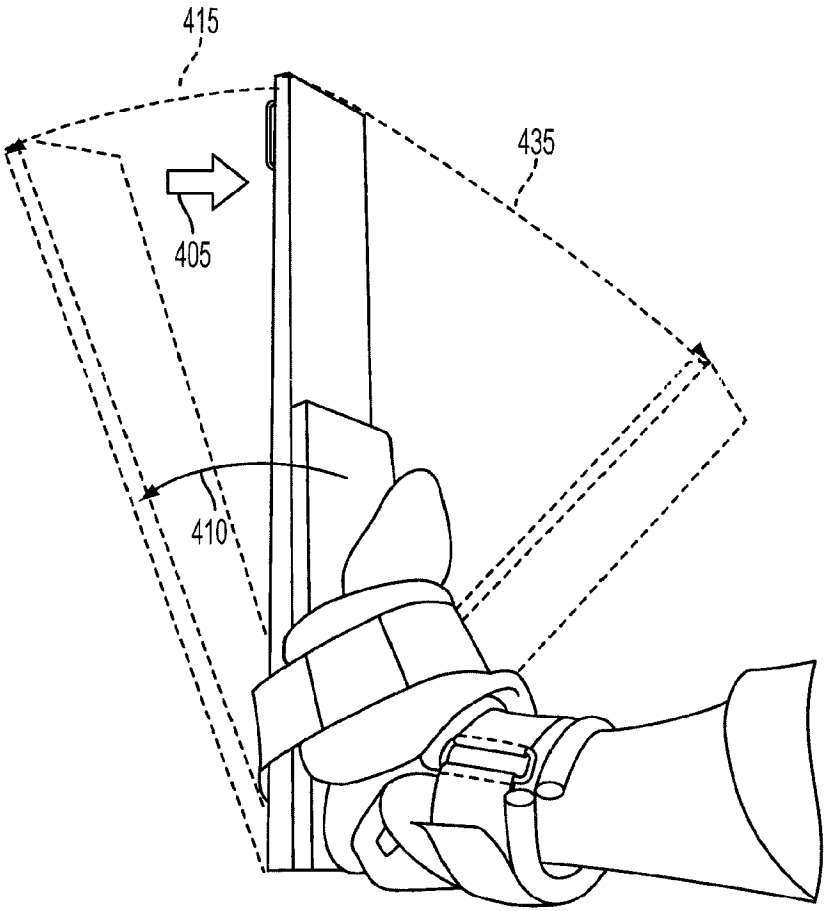

Referring now to FIGS. 3 and 4A-4B, a method for resistance stretching of muscles of the lower leg 110 of a human user is described. FIG. 3 is a flowchart corresponding to the method for resistance stretching of muscles of the lower leg 110 of a human user according to one embodiment of the present invention. FIG. 4A is a side-view diagram illustrating arcs of movement of a human foot 125 according to the method of resistance stretching of muscles of the posterior portion 120 the lower leg 110 of a human user according to one embodiment of the present invention. FIG. 4B is a perspective view diagram illustrating arcs of movement of a human foot 125 according to the method of resistance stretching of muscles of the anterior portion 115 the lower leg 110 of a human user according to one embodiment of the present invention.

The method begins with providing 310 a device, e.g., 205, for use in conjunction with the method. The device is attached to the foot 125 of a human user, acting as a lever arm for hinging the foot 125 about the ankle joint 150.

Using the device, pressure is applied 320 to the elongated portion of the device for resistance against a series of concentric contractions of the muscles of the lower leg 110. Each concentric contraction involves the human user hinging the foot 125 about the ankle joint 150 to activate the muscles of the lower leg 110, such that the movement of the manipulation end of the elongated portion of the device traces an arc, shortening the muscles of the lower leg 110. The concentric contractions are repeated until at least one of the muscles of the lower leg 110 becomes fatigued.

Referring now to FIG. 4A, an embodiment for using the device to apply 320 pressure to the elongated portion for resistance against a series of concentric contractions of the posterior 120 muscles of the lower leg 110 is shown. The foot 125 is placed at the attachment end 225 of the top surface 215 of the elongated portion of the device 205 and secured to the device 205 with a fastening means 240, such that the elongated portion acts as a lever arm for hinging the foot 125 about the ankle joint 150. Pressure is applied to the elongated portion of the device 205 in the direction shown by arrow 405, as resistance against a series of concentric contractions of the muscles of the lower leg 110, in the direction shown by arrow 410. This movement of the foot 125 is a concentric contraction of the muscles of the posterior portion 120 of the lower leg 110, i.e., a shortening of those muscles. The movement traces arc 415 as shown in FIG. 4A. The movement may include the toe end 145 of the foot 125 extending away from the anterior portion 115 of the lower leg 110.

Referring now to FIG. 4B, an embodiment for using the device to apply 320 pressure to the elongated portion for resistance against a series of concentric contractions of the anterior 115 muscles of the lower leg 110 is shown. The foot 125 is placed on the top surface 215 of the device 205, with the toes end 145 at the attachment end 225 of the device. Pressure is applied on the elongated portion in the direction shown by arrow 420, as resistance to movement of the foot 125 about the ankle bone 150 in the direction shown by arrow 425. This movement of the foot 125 is a concentric contraction of the muscles of the anterior portion 115 of the lower leg 110, i.e., a shortening of those muscles. The movement traces arc 430 as shown in FIG. 4B. The movement may include the toe end 145 of the foot 125 moving toward the anterior portion 115 of the lower leg 110.

Referring again to FIG. 3, subsequent to fatigue of at least one of the muscles, pressure is applied 330 the elongated portion of the device for supplying force sufficient for performing one or more eccentric contraction of the muscles of the lower leg 110. Each eccentric contraction involves the human user hinging the foot 125 about the ankle joint 150 opposite force sufficient to overcome the user's force, such that the movement of the manipulation end of the elongated portion of the device traces an arc, lengthening the muscles of the lower leg 110. One or more eccentric contractions may be performed, however, the number of eccentric contractions should be less than the number of concentric contractions in step 320. The proportion is significant because the concentric phase activates and recruits muscle tissue that is presently able to contract. The eccentric phase releases muscle tissue that was previously stuck or knotted, increasing the intensity of the exercise rapidly such that soreness-causing byproducts are released (e.g., lactic acid) and overstressing of the muscle can occur. This proportion allows for the maximum benefit with minimum soreness or muscular stress.

Referring now to FIG. 4A, an embodiment for using the device to apply 320 pressure to the elongated portion for supplying force sufficient to performing one or more eccentric contraction of the muscles of the posterior portion 120 of the lower leg 110 is shown. The device 205 is secured to the foot 125 as described above. Pressure is applied in the direction shown by arrow 405, opposite movement of the foot 125 about the ankle bone 150 in the direction shown by arrow 410, i.e., the toe end 145 of the foot 125 moving toward the anterior portion 115 of the lower leg 110, sufficient to overcome the user's force. This movement of the foot 125 is an eccentric contraction of the muscles of the posterior portion 120 of the lower leg 110, i.e., a lengthening of those muscles under resistance. The movement traces arc 435 as shown in FIG. 4A.

Referring now to FIG. 4B, an embodiment for using the device to apply 320 pressure to the elongated portion for supplying force sufficient to performing one or more eccentric contraction of the muscles of anterior portion 115 of the lower leg 110 is shown. Pressure is applied in the direction shown by arrow 420, opposite movement of the foot 125 about the ankle bone 150 in the direction shown by arrow 425, i.e., the toe end 145 of the foot 125 extending away from the anterior portion 115 of the lower leg 110, sufficient to overcome the user's force. This movement of the foot 125 is an eccentric contraction of the muscles of the anterior portion 115 of the lower leg 110, i.e., a lengthening of those muscles under resistance. The movement traces arc 440 as shown in FIG. 4B.

Thus, according to the various embodiments described herein, the method includes providing a device acting as a lever arm for hinging the foot about an ankle joint while securing the foot against the device, applying pressure on the device for resistance against a series of concentric contractions of the muscles of the lower leg sufficient to fatigue at least one of the muscles of the lower leg, and then applying pressure on the elongated portion of the device for supplying force sufficient to hinge the foot about the ankle joint in the opposite direction as the human user resists the force, thereby performing an eccentric contraction of the muscles.

The above method may be performed by a practitioner, e.g., a physical or occupational therapist or physician, or may be performed by self-manipulation by the user according to various embodiments. In the former embodiment, the practitioner applies the forces to the manipulation end of the device, for example using his or her hands, upper body strength, and body weight for additional leverage. In this example, communication between the practitioner and the user is important to assess effectiveness of the contractions, and with respect to the point at which the user's muscles become fatigued.

Figure 5A:
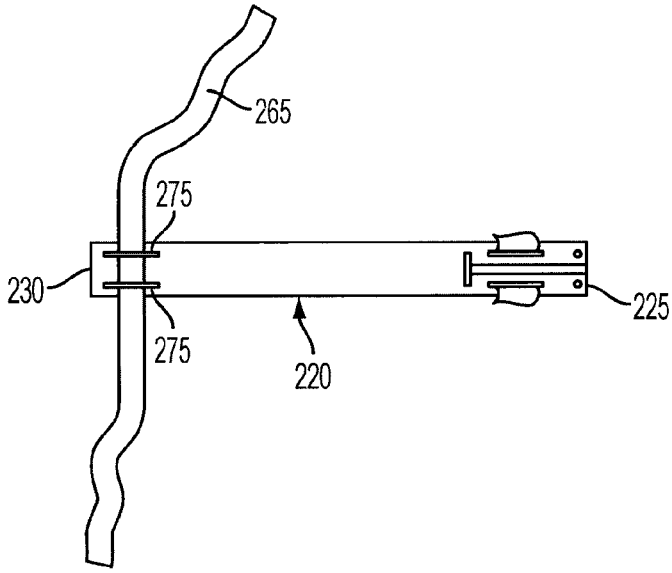
FIG. 5A is a plan view of the bottom surface of the device of FIGS. 2A-E according to one embodiment of the present invention.
Figure 5B:
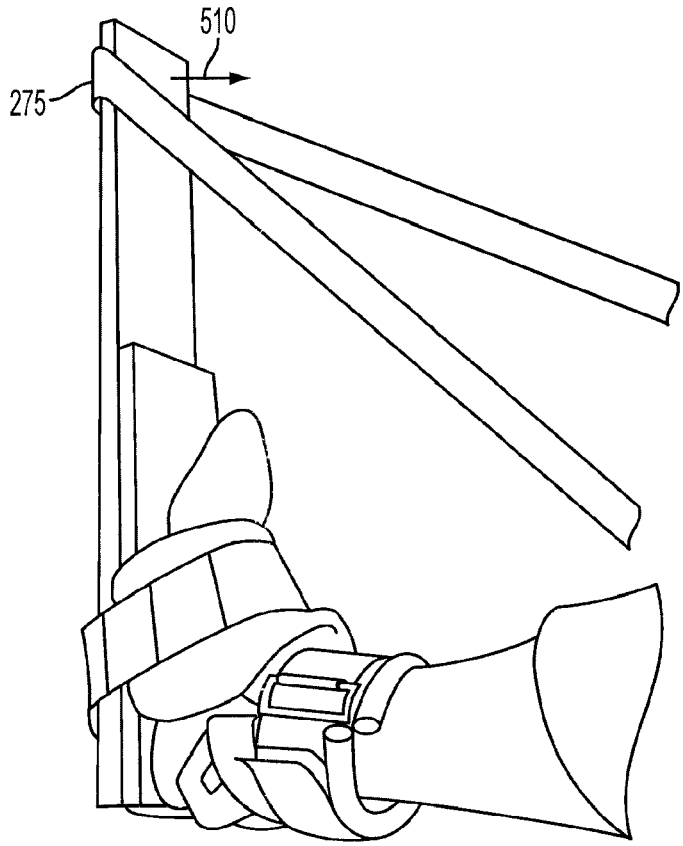
FIG. 5B is a perspective view of a strap in place on a device for stretching and strengthening the muscles of the lower leg according to one embodiment of the present invention.

In an embodiment in which the user performs self-manipulation to achieve the contractions described herein, an additional self-manipulation strap may be used in conjunction with the device. FIG. 5A is a plan view of the bottom surface 220 of the device 205 of FIGS. 2A-E. Two additional attachment points 275 are provided for securing a self-manipulation strap 265. The strap 265 is used to generate the forces described in conjunction with the above method, e.g., forces in directions 405 and 420 as shown in FIGS. 4A and 4B. For example, FIG. 5B shows a strap 265 in place on a device, with tension being applied by a user, to create force 510.

The present invention has been described in particular detail with respect to one possible embodiment. Those of skill in the art will appreciate that the invention may be practiced in other embodiments. First, the particular naming of the components, capitalization of terms, the attributes, data structures, or any other structural aspect is not mandatory or significant, and the mechanisms that implement the invention or its features may have different names, formats, or protocols. Also, the particular division of functionality between the various components described herein is merely exemplary, and not mandatory; functions performed by a single system component may instead be performed by multiple components, and functions performed by multiple components instead may be performed by a single component.

Finally, it should be noted that the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention, which is set forth in the following claims.

The invention claimed is:

1. A device adapted for resistance stretching of muscles of a lower leg of a human user, the device comprising:

an elongated portion, defining a first plane, comprising a top surface, the top surface adapted for placement of a bottom surface of a foot of the lower leg of the human user, the bottom surface having a plurality of attachment members extending outward from the bottom surface, the elongated portion having a length between 23 and 25 inches with an attachment end and a manipulation end, the elongated portion acting as a lever arm adapted for hinging the foot about an ankle joint;

a fastening means fixed near the attachment end adapted for securing the foot against the top surface of the elongated portion, the fastening means comprising:

a first fastener, transverse and approximately perpendicular to the length of the elongated portion when unsecured in a first position, adapted for extending over a metatarsal region of the foot when in a second position for securing the foot against the top surface of the elongated portion such that one end of the bottom surface of the foot is substantially aligned with the attachment end of the elongated portion, the first fastener comprising:

a first end fixedly secured to a first attachment member of the plurality of attachment members on a first side edge portion of the bottom surface of the elongated portion; and a second end adjustably connectable to a second attachment member of the plurality of attachment members on a second side edge portion of the bottom surface of the elongated portion when in a second position, the second attachment member located parallel to the first attachment member; and a second fastener, comprising:

a first portion extending longitudinally from the attachment end of the elongated portion, the first portion extending in the first plane when in an unsecured position and in a second plane in a secured position, the second plane perpendicular to the first plane; and a second portion fixedly secured and perpendicular to the first portion, the second portion adapted for encircling the lower leg just above the ankle joint when in the secured position; and a flexible self-manipulation strap, secured to a third attachment member and a fourth attachment member of the plurality of attachment members, adapted for allowing the human user to apply pressure via the manipulation end of the elongated portion, the third attachment member and the fourth attachment member provided on the bottom surface of the elongated portion at the manipulation end and arranged parallel to the first and second attachment members.

2. The device of claim 1, wherein the hinging of the foot about the ankle joint further affects isometric contractions of the muscles of the lower leg.

3. The device of claim 1, wherein the first and second fasteners allow for manipulation of the elongated portion corresponding to the hinging of the foot about the ankle joint to affect concentric and eccentric contractions of the muscles of the lower leg.

4. The device of claim 1, wherein the elongated portion is rectangular.

5. The device of claim 1, further comprising a cushion portion secured to the top surface of the elongated portion, the cushion portion approximately half the length of the elongated portion.

6. The device of claim 1, wherein the elongated portion is solid.

7. The device of claim 1, wherein each of the plurality of attachment members is substantially U-Shaped.

8. The device of claim 1, further comprising a cushion portion secured to the top surface of the elongated portion, the cushion portion approximately half the length of the elongated portion.

* * * * *